United States Patent [19]

Tajima et al.

[11] Patent Number: 4,873,551

[45] Date of Patent: Oct. 10, 1989

[54] DEVELOPING APPARATUS USING MAGNETIC CARRIER UNDER AC FIELD

[75] Inventors: Hatsuo Tajima, Matsudo; Atsushi Hosoi, Tokyo; Norihisa Hoshika, Kawasaki; Hiroshi Tajika; Masahide Kinoshita, both of Yokohama, all of Japan

[73] Assignee: Canon Kabushiki Kaisha, Tokyo, Japan

[21] Appl. No.: 168,434

[22] Filed: Mar. 15, 1988

[30] Foreign Application Priority Data

Mar. 16, 1987 [JP] Japan ..... 62-60454
Mar. 16, 1987 [JP] Japan ..... 62-60464

[51] Int. Cl.[4] ..... G03G 15/09

[52] U.S. Cl. ..... 355/251; 118/657; 355/253

[58] Field of Search ..... 355/3 R, 3 DD, 14 D, 355/245, 251, 253, 259; 118/657, 658

[56] References Cited

U.S. PATENT DOCUMENTS 4,391,891 7/1983 Tamaura et al. ..... 118/657 X
4,482,244 11/1984 Yamazaki et al. ..... 355/3 DD X
4,672,017 6/1987 Kamezaki ..... 118/658 X
4,686,935 8/1987 Matsui et al. ..... 118/658
4,710,015 12/1987 Takeda et al. ..... 355/3DD

*Primary Examiner*—Fred L. Braun
*Attorney, Agent, or Firm*—Fitzpatrick, Cella, Harper & Scinto

[57] ABSTRACT

The present invention relates to a developing apparatus using magnetic carrier particles and toner particles under the influence of an alternating current. One embodiment of the present invention includes a developer which is a mixture of toner particles and resin coated magnetic particles. An alternating electric field is formed between a latent image bearing member and developer carrying member to form a toner image corresponding to an electrostatic latent image. An electric resistivity curve of the magnetic particles on a coordinate graph, where the abscissa represents an electric field E (V/cm) applied to the magnetic particles and the ordinate represents an electric resistivity R (ohm-cm) of the magnetic particles, crosses a zone defined by lines, AB, BD, DC and CA, where A is a point with coordinates ($0.2\times10^3$, $10^{11}$);
B is a point with coordinates ($2\times10^3$, $3\times10^9$);
C is a point with coordinates ($0.2\times103$, $10^8$); and
D is a point with coordinates ($2\times10^3$, $2\times10^7$).

The resistivity R is measured by a sandwich type cell having electrodes with a clearance of 0.4 cm and an electrode area of 4 cm$^2$, in which 1 kg wt. is applied to one of the electrodes, and a voltage is applied across the electrodes.

14 Claims, 5 Drawing Sheets

DEVELOPING APPARATUS USING MAGNETIC CARRIER UNDER AC FIELD

FIELD OF THE INVENTION AND RELATED ART

The present invention relates to a developing apparatus using magnetic carrier particles and toner particles under existence of an alternating electric field. The developing apparatus according to this invention is applicable to a displaying apparatus, a printer, a facsimile machine and an electrophotographic apparatus wherein images are formed.

U.S. Ser. Nos. 906,080 now abandoned and U.S. Ser. No. 015,929, now abandoned, filed Sept. 10, 1986 and Feb. 18, 1987 which assigned to the assignee of the present invention propose developing methods wherein the developing efficiency and image quality are improved. Those proposals are related to a developing method and apparatus using a thin layer of two component developer and an alternating electric field, and the method and apparatus thereof are better in various respects than conventional developing method and apparatus using two component developer with a clearance of approx. 5 mm between a latent image bearing member and a developer carrying member and than the method and apparatus similar thereto but with an alternating electric field, as disclosed in Japanese Laid-Open Patent Application No. 32060/1980.

The inventions disclosed in the U.S. Applications are effective to remarkably reduce the problem of carrier particles remaining on the photosensitive member under the application of the alternating electric field, and the developed image is faithful to the potential of the latent image.

Carrier particles used with ordinary developing apparatus using the two component developer are carrier particles having an intermediate electric resistance such as a conductive carrier or a carrier made of ferrite only. Those carrier particles are easily deteriorated by deposition of the toner particles thereto, and therefore there are problems in the durability and/or the decrease in the charged application power to the toner particles.

It is known that in order to improve the durability or the charge application power, resin coated carrier particles are used. The conventional carrier particles coated with resin show a quite high insulative property, so that the charge application power is increased, and in addition, since the surface property is good, they are practically preferable from the standpoint of the durability.

In the developing system using a two component developer under existence of the alternating electric field, it is naturally considered to use the high resistance carrier particles coated with resin to obtain the durability. However, the inventors have found new problems which will be described in detail hereinafter. There is another high resistance carrier, that is, a resin bound magnetic carrier particles, which show a very high electric resistance. This is preferable since electric leakage can be prevented in a developing zone, and since a high latent image potential and a strong alternating electric field can be used, so that good development properties by the alternating electric field can be expected. However, it has been found that if the resistance of the insulative carrier particles is not less than 1014 ohm.cm, they are charged to a quite high voltage level in the polarity opposite to that of the toner, with the result that the carrier particles are easily deposited in the non image area or a solid white area; and that an edge effect appears remarkably despite the use of the carrier particles.

Additionally, it has been found that this is further remarkable when the carrier particles are deteriorated or when the toner charging property or a carrier property are changed greatly by variation of ambient conditions. Also, loss (by deposition onto the photosensitive member) of carrier particles is a significant problem with the cleaning operation for the photosensitive member, the image transfer operation or the like.

SUMMARY OF THE INVENTION

The inventors have found and noted that a cause of a sudden occurrence of abnormal developing operation which has not been revealed is mainly in the content of chains formed by magnetic carrier particles and/or the magnetic carrier particles per se in the developing zone.

It is a principal object of the present invention to provide a developing apparatus using an alternating electric field wherein the loss of high resistance carrier particles can be remarkably reduced.

It is another object of the present invention to provide a developing apparatus wherein the resistance of a high resistance carrier particles under the condition of changing alternating electric field is considered, in addition to the resistance thereof at one particular condition.

It is a further object of the present invention to provide a developing apparatus wherein the loss of the carrier particles per se is significantly reduced without disturbing the developing action under the application of the alternating electric field, whereby the developing operation can be stabilized for a long period of term.

It is a yet further object of the present invention to provide a developing apparatus provided on the basis of a number of experiments and investigations, by which the developing operation is stabilized to such an extent that the results are not expected.

It is a still further object of the present invention to provide a developing apparatus wherein the developing action under the application of an alternating electric field is highly improved by use of a specific carrier particles coated with resin, so that good images can be provided.

An embodiment of the present invention is accomplished as a result of particularly noting the electric resistance of carrier particles coated with resin and looking for a property different from that of conventional carrier particles. According to this embodiment, the durability is improved with the toner charging property and an electrode effect being maintained to provide good quality of images.

More particularly, the inventors have particularly noted the electric resistance or resistivity of resin coated carrier particles, and the present invention is based on the finding that the quality of the developed image is significantly influenced by change of the electric resistance of the carrier particles which is depending on the electric field applied.

According to this embodiment of the present invention, there is provided a developing method using a developer which is a mixture of magnetic particles and toner particles, wherein an alternating electric field is formed between a latent image bearing member and a developer carrying member to form a toner image corresponding to an electrostatic latent image, and wherein an electric resistivity curve of the magnetic particles on a coordinate graph wherein abscissa represents an electric field E (V/cm) applied to the magnetic particles, and ordinate represents an electric resistivity R (ohm-cm) of the magnetic particles crosses a zone defined by lines AB, BD, DC and CA, where A is a point with coordinates ($0.2\times10^3$, $10^{11}$);

B is a point with coordinates ($2\times10^3$, $3\times10^9$);

C is a point with coordinates ($0.2\times10^3$, $10^8$); and

D is a point with coordinates ($2\times10^3$, $2\times10^7$), wherein the resistivity R is measured by a sandwich type cell having electrodes with a clearance of 0.4 cm and having electrode area of 4 $cm^2$, in which 1 kg wt. is applied to one of the electrodes, and a voltage is applied across the electrodes.

The present invention is applicable, with the good advantages maintained, to the case where the developer is in contact with the photosensitive member without an alternating electric field in the developing zone and to the case where the developer is not contacted under the same condition.

A second embodiment of the present invention is based on experimental results and are particularly directed to the number of magnetic particle chains under the existence of the magnetic field. Similarly to the first embodiment, the loss of the carrier particles which is caused by the carrier particles being deposited on the surface of the photosensitive member can be prevented.

According to this embodiment, there is provided a developing apparatus using a developer containing magnetic particles and toner particles to develop a latent image in a developing zone, comprising a container for containing a developer which contains the toner particles and the magnetic particles, a developer carrying member, opposed to the electrostatic latent image bearing member, for forming a developing position for supplying the toner particles to the latent image bearing member and for carrying the developer from the container to the developing zone, first magnetic field generating means disposed across said developer carrying member from the latent image bearing member for generating a magnetic field to contact the magnetic particles to the latent image bearing member at the developing zone, developer regulating means, disposed upstream of the developing zone with respect to movement of a surface of the developer carrying member and spaced apart from the surface of the developer carrying member, for regulating the developer carried to the developing zone, second magnetic field generating means, disposed across said developer carrying member from said regulating member and disposed upstream of the developer regulating member with respect to the movement, and alternating electric field generating means for forming an alternating electric field at the developing zone to transfer at least the toner particles carried on the developer carrying member to the latent image bearing member, wherein $1.7\leqq(X/Y)\leqq7.0$;

$4.9(X/Y)^{-1.8}\leqq Z\leqq18.3(X/Y)^{-0.9}$; and $Z\leqq6.5$ are satisfied, where Z is a number of chains of the magnetic particles per 1 $mm^2$ on the surface of the developer carrying member in the developing zone, X (mm) is height of the chains in the developing zone, and Y (mm) is a smallest distance between the latent image bearing member and said developer carrying member.

According to this embodiment, the development properties are improved, and the development efficiency can be made sufficiently high together with prevention of the loss of the carrier particles, without use of the magnetic carrier particles having the resistance described above. In addition, the image density is increased within a proper range.

A third embodiment of the present invention is a combination of the first and second embodiments described above. Since the first and second embodiments are compensatory with each other, the loss of the carrier particles is prevented very stably even under a high speed developing operation or other special ambient conditions in which the developing operation is liable to become unstable as a result of not sufficiently responsive to abrupt or great changes in the resistance of the carrier particles, in the number of the carrier particle chains, in the ambient conditions and/or in the toner content in the developer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
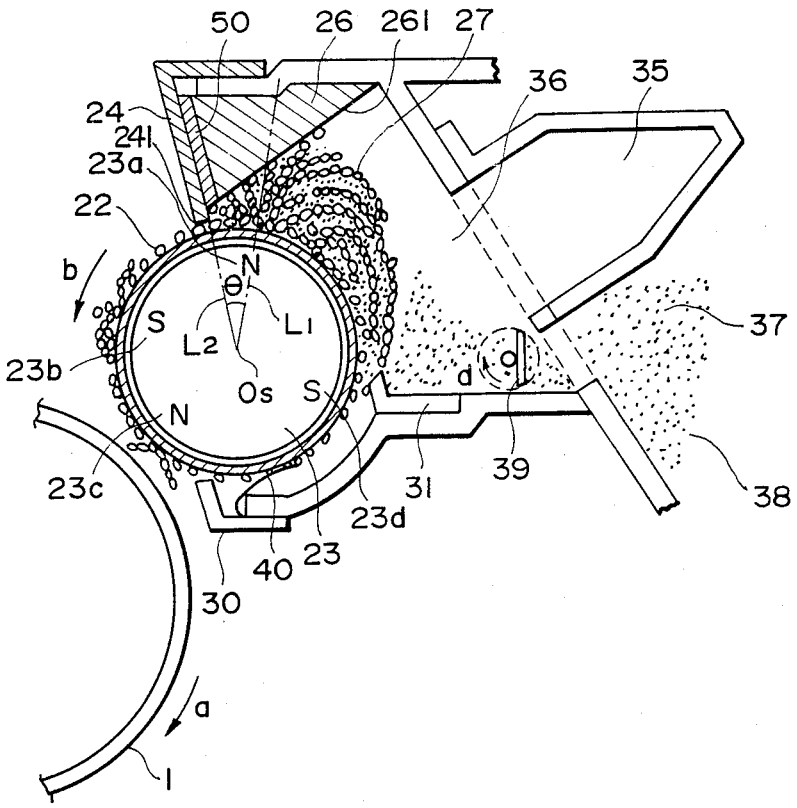
FIG. 2 is a sectional view of a developing apparatus according to the present invention.

Referring first to FIG. 2, there is shown a developing apparatus in a cross section according to an embodiment of the present invention. Designated by a reference numeral 1 is a latent image bearing member such as an insulative drum for electrostatic recording and a photosensitive drum or belt having a photoconductive insulative layer such as an amorphous selenium, CdS, $ZnO_2$, OPC (organic photoconductor) and an amorphous silicon. The latent image bearing member 1 is rotated in a direction indicated by an arrow a by an unshown driving mechanism, during which an electrostatic latent image is formed by a well-known image forming means. To the latent image bearing member 1, a developing sleeve 22 is disposed opposed to or in contact to the latent image bearing member 1. The developing sleeve 22 is made of a non-magnetic material such as aluminum and stainless steel (SUS) 316. The developing sleeve 22 is supported for rotation in the direction indicated by an arrow b with its substantially a half periphery (right) being contained in a developer container 36 and with its remaining half (left) periphery being exposed to the outside through an opening formed in the bottom left portion of a wall of the developer container.

A stationary permanent magnet 23 is contained in the developing sleeve 22, and it functions to generate a stationary magnetic field. In this embodiment, the magnet 23 is not rotated even when the developing sleeve 22 is rotated. The magnet 23 has a north pole 23*a*, a south pole 23*b*, a north pole 23*c* and a south pole 23*d* (four magnetic poles), in this embodiment. The magnet 23 is shown as a permanent magnet, but it may be an electromagnet.

A non-magnetic blade 24 has a base portion which is fixed to a wall of the container 36 above the top edge of the opening in which the developing sleeve 22 is disposed, and it has a free bottom edge which is projected into the opening of the container 36 adjacent the upper edge of the opening. The blade is made of a non-magnetic material and is extended along the length of the opening to function as a developer regulating member. It may be a plate made of SUS 316 or the like bent into an L shape.

A magnetic particle limiting member 26 has a top surface contacted to the bottom surface of the non-magnetic blade 24 and a front surface functioning as a developer guiding surface 261.

The magnetic particles are designated by a reference numeral 27 and have a particle size (diameter) of 20–100 microns, preferably 30–80 microns and an apparent density of approx. 2.4–2.8 g/cc. The magnetic particles are made of ferrite particles (maximum magnetization 60–70 emu/g) coated with resin.

If it is smaller than 20 microns, the erection of the chains is not sufficient so that non-uniform images are produced. If, on the contrary, it is larger than 100 microns, the triboelectric charge application decreases, and the damage to the photosensitive drum is increased.

The non-magnetic developer (toner) is designated by a reference 37.

A magnetic member 31 is mounted to an inside surface of the developer container 36 at a lower portion thereof and is opposed to the developing sleeve 22 in order to prevent leakage of the magnetic particles 27 and the non-magnetic toner particles 37 from the developer container 36 below the developing sleeve 22. The magnetic member 31 is made of, for example a plated ion plate. A magnetic field formed between the magnetic member 31 and the south magnetic pole 23d is effective to provide a sealing effect for preventing the leakage while allowing the magnetic particles 27 to return into the container 36 on the sleeve 22.

A toner supplying member 39 functions to supply the toner particles into the magnetic brush of the magnetic particles formed by the stationary magnetic pole 23 in the developing sleeve 22. The toner supplying member 39 is of a metal plate coated with a rubber sheet rotatably supported and conveys the toner as if it sweeps the bottom surface of the container 36. To the toner supplying member 39, the toner is supplied by an unshown toner conveying member provided in the toner container 38.

The magnetic particles have been contained in the magnetic particle container 35.

Adjacent the bottom of the developer container 39, there is provided a sealing member 40 for sealing the toner stagnating at the bottom portion of the developer container 36. The sealing member 40 is flexible and is bent along the rotational direction of the sleeve 22 to be resiliently urged to the surface of the sleeve 22. The sealing member 40 has an edge at a downstream side of the contact area therebetween with respect to the rotational direction of the sleeve to allow the developer to return into the container 36.

A scatter preventing electrode plate 30 is supplied with a voltage having a polarity which is the same as that of floating developer produced by the developing operation to urge the floating developer to the photosensitive member 1 to prevent the floating developer from being scattered.

The south pole 23*d* generates a magnetic field between itself and a magnetic member 31 to provide a magnetic seal. Only a part of the magnetic member 31 is opposed to the magnetic pole 23*d*. The magnetic member 31 is disposed at a bottom portion of the developer container 36 at a substantial end of the developer accommodating portion of the developer container 36. Adjacent this end portion, the movement of the returned magnetic carrier particles is effective to incorporate the toner particles adjacent the bottom of the container 36 into the developer on the surface of the sleeve 22. Therefore, the stabilized collection of the magnetic particles leads to the stabilized developing operation.

Further, by disposing the magnetic pole 23*d* in the manner described above, an additional advantage can be provided in connection with the magnetic pole 23*a*. Due to the above described relationship between the bottom of the developer containing portion of the container 36 and the magnetic pole 23*d*, the magnetic brush is not formed with a smaller density as compared with the state of stagnation, and therefore, the toner particles are not excessively taken into the magnetic brush of the magnetic particles. This is advantageous because if the toner is excessively taken by the magnetic brush, the charge of the toner becomes insufficient with the result of formation of a foggy background.

This structure is effective when the developer container contains magnetic particles and non-magnetic or weakly magnetic toner particles.

The distance $d_2$ between an edge 241 of the non-magnetic blade 24 end and the developing sleeve 22 is 50–800 microns, preferably 150–500 microns. If the clearance is smaller than 50 microns, the magnetic particles are more easily clogged in the clearance, resulting in formation of a non-uniform developer layer, and it becomes not possible to apply on the sleeve 22 sufficient amount of developer to perform a good developing operation, and therefore, a developed image having a lower density and having non-uniformness results. If, on the contrary, it is larger than 800 microns, the amount of the developer layer on the developing sleeve 22 increases so that a desired regulation of the developer layer thickness can not be expected. This results in a larger amount of the magnetic particles deposited onto the latent image bearing member, and the circulation of the developer which will be described hereinafter and the developer limiting action by the developer limiting member 26 are weakened, with the result of insufficient triboelectric charge being applied to the toner, which leads to production of a foggy background.

A magnetic particle layer is formed adjacent the sleeve 22 surface by the attraction force provided by magnetic poles of the magnetic field generating means 23. The magnetic particle layer is moved, when the sleeve 22 is rotated in the direction b, by the balance between the confining force provided by the magnetic force and by the gravity force and the conveying force provided by the movement of the sleeve 22. However, the movement of the developer particle layer becomes slow with a distance from the surface of the sleeve 22 to form a stationary layer at an outside portion of the magnetic particle layer, which is substantially stationary although slightly movable. Some part thereof falls by the influence of the gravity.

Therefore, by properly selecting the positions of the magnetic poles 23*a* and 23*d*, the fluidability of the magnetic particles 27 and a magnetic property thereof, a movable magnetic particle layer is formed adjacent the surface of the sleeve 22, which is moved toward the magnetic pole 23*a*. The movable layer takes thereinto the toner from the toner layer outside the magnetic particle layer. The toner is triboelectrically charged by the friction of the magnetic particles and the surface of the sleeve 22, and the triboelectrically charged toner is conveyed to the developing zone by the rotation of the sleeve 22 and is used for the developing operation.

The movement of the magnetic particle layer is determined by the fluidability of the developer and the magnetic force thereto, and when the toner content is low in the magnetic powder, the stationary layer is small, so that most of the magnetic particles in the magnetic particle layer move quickly and take the toner particles from the toner layer into among them. When the toner content is high, the stationary layer becomes larger, so that the movable part of the magnetic particle layer is almost covered by the stationary layer and becomes unable to contact the toner layer so that the toner is hardly taken thereinto. In this manner, the toner content is substantially maintained naturally.

Now, the description will be made with respect to the magnetic particle layer adjacent the non-magnetic blade 24 and adjacent the circulation limiting member 26. The limiting member 26 functions not only to mechanically prevent unnecessary toner from going into the developer regulating zone. In the regulating zone defined by the limiting member 26 and the sleeve 22, the magnetic particles conveyed by the rotation of the sleeve 22 and the function of the magnetic pole 24*a* are packed along a guiding surface 261 of the limiting member 26 so that the density of the magnetic particles there is increased. In this zone, the magnetic particles newly introduced by the conveyance and the magnetic particles discharged under the blade 24 are dynamically exchanged, and therefore, the magnetic particles collide to produce a stirred state, although a substantially packed state is formed. By this, the toner particles are triboelectrically charged by contact with the magnetic particles and/or the surface of the sleeve 22, and the toner particles which are insufficiently charged and therefore are deposited with weaker force to the magnetic particles and/or the surface of the sleeve 22 are released from the magnetic particles and/or the surface of the sleeve 22. In other words, the selection of the toner or the improvement in the charging of the toner are performed, in effect. Therefore, it becomes possible to provide the toner which has been sufficiently charged triboelectrically to the developing zone. Also, the non-uniformness of the magnetic particles during the conveyance is made uniform in the regulating zone, so that the magnetic particles are formed into a uniform and stabilized magnetic particle layer applied on the surface of the sleeve 22. Therefore, it is important that the limiting member 26 is provided with the guiding surface 261, and the inclination of the surface 261 and the volume of the regulating zone or space are influential to the state of the magnetic particle packing state in this zone.

The magnetic pole 23*a* stationarily disposed in association with this zone is effective to relocate the packed magnetic particles along the magnetic line of force. The packing state in this zone is influential to the triboelectric charge application to the toner, and therefore, it is desirable that a constant packing state is maintained to stabilize the triboelectric charge application. Since the magnetic pole 23*a* is effective to form a magnetic brush with a force substantially perpendicular to the tangential direction on the sleeve along which the magnetic particles have been conveyed, the magnetic powder is loosened in addition to being stirred, so that the uniformization and the stabilization of the triboelectric charge application to the toner and the formation of the magnetic particle layer on the sleeve are further promoted. At this time, if the packed developer is maintained under a high pressure, the developer is clogged too much, which is a problem. However, by opposing the position of the maximum magnetic force provided by the magnetic pole 23*a* to the guiding surface 261, an excessive pressure concentration is prevented in the regulating zone, so that the concentration of the developer and the high content of the magnetic particles can be maintained under an appropriate state.

Accordingly, the regulating zone described above provides a thin developer layer or the sleeve 22 with a stabilized amount of the magnetic particles and sufficiently charged toner particles. Thus, the developing action in the developing zone 102 is stabilized. It has been confirmed that the above described regulating zone is effective particularly in the developing method and apparatus wherein at the devloping zone, an alternating electric field sufficient to transfer onto the electrostatic latent image bearing member at least the toner particles carried on the surface of the developer carrying member surface among the toner particles introduced into the developing zone, and wherein a volumetric ratio of the total volume of the magnetic particles existing at the developing position to a volume of space defined by the surface of the electrostatic latent image bearing member and the developer carrying member at the developing position is 1.5–30%.

In the structure of FIG. 2, a magnetic member 50 is mounted to a non-magnetic blade side of the developer limiting member 26. In this case, it is not preferable to dispose the magnetic member 50 in opposition to the magnetic pole 23*a*, since then a strong magnetic field concentration is produced between itself and the magnetic pole 23*a* with the result that the stirring and loosening actions by the magnetic pole 23*a* on the magnetic powder are decreased. However, it is effective to provide the magnetic member 50 in the regulating zone to magnetically confine the magnetic particles between the magnetic member 50 and the magnet 23 in the sleeve 22, since then the tolerable error in the clearance between the regulating member 24 edge and the sleeve 22 surface can be increased. As compared with the toner particles deposited on the magnetic particles, the toner particles deposited on the sleeve 22 have a smaller amount of charge than those on the magnetic particles. This is because the magnetic particles are conveyed together with movement of the sleeve 22, whereby the opportunity of the toner particles on the sleeve 22 being frictioned with the magnetic particles is small. In order to raise the degree of being charged of the toner on the sleeve 22, it is desirable to positively friction the toner on the sleeve 22. To accomplish this, it is preferable that magnetic particles exist in the neighborhood of the surface of the sleeve 22, which magnetic particles are moved relative to the moving sleeve 22.

However, simply reducing the conveyance property of the magnetic particles is not practically possible, if the above described toner introducing function is to the maintained. Likewise, disposing a magnetic member opposed to the magnetic pole 23*a* in the regulating zone in an attempt to increase the friction of the magnetic particles with the surface of the sleeve 22 results in decrease of the above-described advantage provided by the maximum magnetic force generating portion being opposed to the space defined by the developer circulation limiting member 26.

In consideration of those factors, in the developing apparatus of this embodiment, the magnetic member 50 is disposed opposed to a downstream side of the magnetic pole 23*a* with respect to movement direction of the sleeve 22, so as to substantially concentrate the magnetic lines of force at the blade side provided by the magnetic pole 23*a* in the tangential direction of the surface of the sleeve 22. By doing so, only the magnetic particles that are present in the neighborhood of the surface of the sleeve 22 are formed into a magnetic brush along the surface of the sleeve 22, whereby it frictions with the toner particles on the sleeve 22, thus enhancing the triboelectric charge application to the toner particles on the sleeve 22.

In the apparatus constructed in the manner described above, the developing operation was performed using intermediate resistance carrier particles coated with resin having the following properties:

When a sandwich type cell having a measurement area of 4 $cm^2$ and having a clearance between electrodes of 0.4 cm, and a voltage E (V/cm) is applied across the electrodes under application of 1 kg weight to one of the electrodes, and the electric resistance of the magnetic particles is obtained from the electric current, the resistance of the magnetic particles is $3.1\times10^9$ ohm.cm at $E=0.2\times10^3$; and the electric resistance thereof is 4.0x108 ohm.cm at $E=2\times10^3$.

Here, the resistivities referred to hereinafter are the values obtained by the same measurement.

When the developing apparatus was operated in this manner, the good quality images were provided without carrier particle deposition in the image area, and without white void in the solid black image area.

The reason why the resistivity is defined by the values at the points of $E=0.2\times10^3$ and of $E=2\times10^3$, is that the resistivity change of the magnetic particles exhibiting dependence on the electric field changes significantly in this range, whereas the resistivity decreases much less steeply outside this range, and therefore, the resistivity change in this range is representative of the change in the alternating electric fields.

As a result of various experiments and investigations, the inventors have found that the resistivity change in this range is greatly influential to the development operation, and as a result, the following preferable conditions were obtained.

The conditions can be expressed by the resistivity curve crosses at least one point in an area defined by $$R\leqq-(10^2-3)\times10^9E/1.8\times10^3+(10^3-3)\times10^9/9$$

$$R\geqq-(10-2)\times10^7E/1.8\times10^3+(10^2-2)\times10^7/9$$

within the range of voltage E not less than $0.2\times10^3$ (V/cm) and not more than $2\times10^3$ (V/cm);

where R (ohm.cm) is a resistivity of the magnetic carrier particles.

If this is satisfied, stabilized images can be produced in an alternating electric field without disturbance to the image, with high durability and with reduced loss of carrier particles. Also, since the magnetic particles are coated with resin, the properties of the magnetic particles are not influenced by a change in the ambient humidity, and the flowability is good so that it is practically desirable.

The magnetic particles may be of a known sintered ferrite type and may be made from one or more of Zn, Fe, Cd, Cu, Pb, Ni, Mg and Mn by sintering. The most suitable to the present invention are metal oxide materials mainly containing CuO, ZnO, $Fe_2O_3$.

Figure 1:
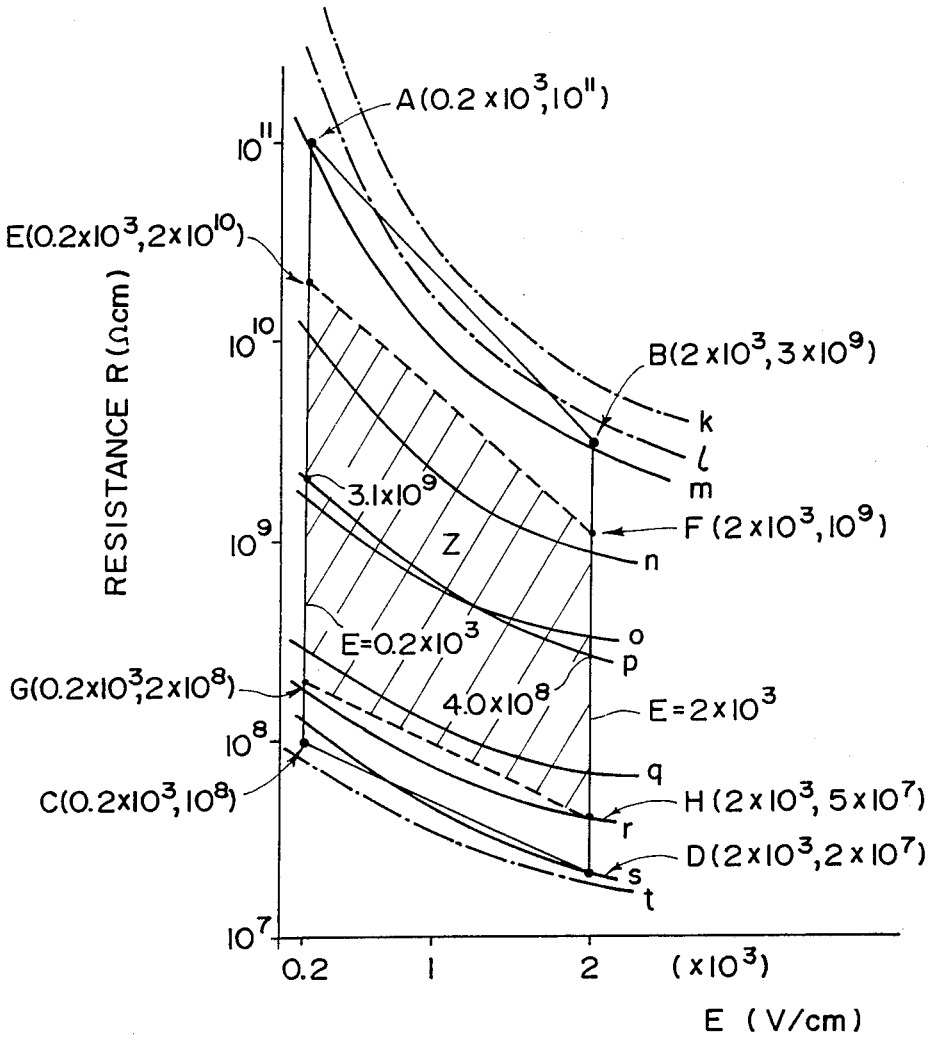
FIG. 1 is a graph illustrating the resistance property of the magnetic carrier particles usable with a developing apparatus according to an embodiment of the present invention.

Referring now to FIG. 1, the description will be made as to the effectiveness of the present invention.

This graph shows an electric resistivity property curve of magnetic particles, more particularly, it shows the resistivity R of the magnetic particles VS the electric field E applied for the measurement, when the sintering condition and/or a resin coating condition to the sintered ferrite particles are changed when the magnetic particles are made from copper oxide and zinc. The property curves are designated by reference characters k, l, m, n, o, p, g, r, s and t. For example, the magnetic particle n is coated with a twice amount of the resin of the magnetic particle p. The measurements were carried out under normal temperature and humidity. As for the material of the coating resin, silicone resin was used. It, however, may be usual carrier coating material for the two component developer which has conventionally been used, for example, acrylic fluorine resin. The maximum magnetization of the magnetic particles is 64 emu/g, and the particle size distribution is 70–50 microns (250/350 meshes).

The following is a table showing the result of evaluation of the image quality provided with the use of the magnetic particles k–t. The amount of resin coating decreases from the particle k to the particle t, and the particle o and the particle p were manufactured under different sintering conditions.

TABLE 1

| k | l | m | n | o | p | q | r | s | t |
|---|---|---|---|---|---|---|---|---|---|
| N | F | G | E | E | E | E | G | F | N |

N: No good
F: Fairly good
G: Good
E: Excellent

Figure 3:
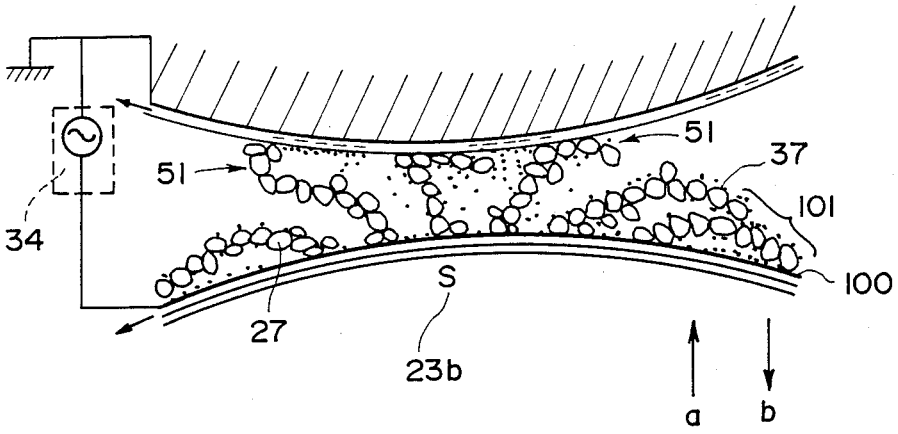
FIG. 3 is an enlarged sectional view illustrating the developing zone or position.

Here, it is added that the insulative carrier particles available in the market show such high resistivities that they are not able to be plotted in the graph of FIG. 3. It has been confirmed that the image formed with the use of such insulative carrier particles involve image voids, depositions of carrier particles, and therefore, are not satisfactory.

The magnetic particle t exhibiting the electric resistivity under the line CD in FIG. 1 shows a property in which the trace of brushing is liable to appear in the developed image, and in which white spots (voids) are liable to be produced in a solid black image. Those result from the leakage of the latent image occurring through the magnetic particles. Additionally, the magnetic particles are liable to be deposited in the solid black image area. According to this embodiment, the resistivity is above the line AB, and therefore, those problems can be prevented.

The magnetic particles showing the resistivities higher than the line AB, and chargeability of the magnetic particle itself is so strong that the toner particles are strongly attached to the magnetic particles with the result of difficulty of transferring to the latent image in the developing zone. Accordingly, the image density reduces. Also, the effect that the magnetic particles perform functions of a developing electrode is reduced, resulting in a decreased density of the image. Further, the magnetic particles are easily charged to the polarity opposite to the charge of the toner, and therefore, the carrier particles are liable to be deposited on the white area (non-image area) of the latent image. Particularly in the developing apparatus in this embodiment of the present invention, the toner particles to be replenished is taken into the magnetic particle powder layer by recirculation of the magnetic particle layer within the developer container, so that if the chargeability of the magnetic particles is too strong, the introduction of the toner particles into the magnetic particle layer is liable to become unstable. If this occurs, non-uniformness or stripes appears in the developed image. However, this embodiment of the present invention provides a solution to these problems. This is important in solving the problems in the apparatus.

The similar experiments were performed with acrylic fluorine resin in place of the silicone resin, the results were substantially the same. When the particle sizes of the magnetic particles were changed, no change was observed in the image. Therefore, it has been confirmed that the resistivity properties described above is very effective in various developing methods using the alternating electric field.

As will be understood from the results of the experiments, it is further preferable that the resistivity in the range between the electric fields of $0.2\times10^3$ and $2\times10^3$ (V/cm), is all included in the above described area. Although the strength of the electric field changes in the case of an alternating electric field, a stabilized development operation can be assured if the resistivity is within the area ABCD only within the range between $E=0.2x10^3$ and $E=2x103$ (V/cm). It should be noted particularly that if the resistivity of the magnetic particles is not less than $10^8$ ohm.cm and not more than $10^{11}$ ohm.cm at $E=0.2\times10^3$ (V/cm), and not less than $10^7$ ohm.cm and not more than $10^9$ ohm.cm at $E=2\times10^3$ (V/cm), the above described desirable developing operation can be provided.

Furthermore, much preferable results were obtained if the following requirement was satisfied. That is, the changing resistivity of the magnetic particles is all within an area Z (hatched area) defined by connecting the four ordinates, i.e. E ($0.2\times10^3$, $2\times10^{10}$), F ($2\times10^3$, $10^9$), H ($2x10^3$, $5x10^7$), G ($0.2\times10^3$, $2\times10^8$). As will be understood from FIG. 1, the area Z is within the above described area.

The reason for this is considered to be that if the curves are extended to predict the situation in the applied voltage under the maximum electric field strength in the actual alternating electric field application, the magnetic particles are expected to exhibit stable high resistivities not less than $5\times10^7$ ohm.cm (at least $2\times10^7$ ohm.cm) and not more than $10^9$ ohm.cm in the developing operation under the maximum alternating electric field, and that under a weaker electric field, the high resistivity in the area Z is exhibited.

In summary, if the magnetic particles having the electric resistivity property not beyond the line AB and not lower than the line CD is used, the problems with the insulative carrier particles coated with resin can be solved.

As described in detail in the foregoing, it will be understood that the area defined by the four lines in FIG. 1, is critical to the quality of the developed image, since the remarkable deterioration of the image quality is observed outside this area.

The magnetic flux density by the pole **23*a*** is not less than 600 Gausses, preferably not less than 700 Gausses. This is because the developer application state is stabilized against toner content change of the magnetic particle layer, where the magnetic flux density by the regulating pole is high. Since the apparatus of this embodiment is not provided with an automatic toner content control means, it is preferably not less than 750 Gausses and further preferably not less than 800 Gausses.

The developing pole **23*c*** is disposed substantially opposed to the developing zone, and the magnetic flux density thereby is preferably not less than 800 Gausses in order to prevent deposition of the magnetic particles to the latent image.

According to this embodiment, a high quality image can be provided, and it is usable with a small size apparatus such as a disposable apparatus.

A toner container 38 is formed horizontally adjacent to the developer container 36. The toner container 38 is equipped with a toner conveying member for conveying the toner into the developer container 36.

In this embodiment, the regulating pole **23*a* and the developing pole 23*c* are spaced with a substantial distance, and therefore, a south pole 23*b* is disposed therebetween to prevent the developer layer uniformly applied on the developing sleeve 22 by the non-magnetic blade 24 is prevented from being disturbed, so that it functions as a conveying magnetic pole. In order not to disturb the developer layer, the strength of the magnetic pole 23*b* is preferably equivalent to or slightly smaller than that of the developing electrode 23*c***.

When the diameter of the developing sleeve 2, is 20 mm, the disturbance of the developer layer on the sleeve 22 is not significant if the angular interval between the regulating pole and the developing pole is not more than 110 degrees as seen from the center of the sleeve 22. If, however, it is larger than 110 degrees, the disturbance of the developer layer is significant, and therefore, it is preferable that a conveying pole is provided between the magnetic poles **23*a* and 23*c***.

The magnetic pole **23*d* serves to collect the developer after the developing position and is disposed upstream of the edge of the magnetic seal with respect to movement of the developing sleeve 22. If, it is disposed downstream, chains of magnetic particles are erected by the magnetic pole 23*d* in the neighborhood of the toner receiving opening adjacent the bottom of the developer container 36**, with the result that the toner particles are extremely easily taken into the magnetic powder so that the triboelectric charge to the toner becomes insufficient, which leads to production of the foggy background.

Now, the description will be made with respect to the volumetric ratio of the magnetic particles at the developing station. The "developing position" or "developing zone" is defined as the region in which the toner particles are transferred or supplied from the sleeve 22 to the photosensitive drum 1. The "volumetric ratio" is the percentage of the volume occupied by the magnetic particles present in the developing position or zone to the entire volume of the developing position or zone. The volumetric ratio is significantly influential in this developing apparatus, more particularly, it is preferable that the volumetric ratio is 1.5–30%, more preferably 2.6–26%.

If this is smaller than 1.5%, the problems have been confirmed that the image density of the developed image is too low; that a ghost image appears in the developed image; a remarkable density difference occurs between the position where the chain 51 exists and the position where no chain exists; and or that the thickness of the developer layer formed on the sleeve 22 is not uniform.

If the volumetric ratio is larger than 30%, the surface of the sleeve is closed, that is, covered by the magnetic particles too much, and a foggy background results.

It should be appreciated that the image quality does not monotonously become better or worse with the increase or decrease of the volumetric ratio; that the satisfactory image density can be obtained within the range of 1.5–30% of the volumetric ratio; the deterioration of the image is recognized both below 1.5% and beyond 30% of the volumetric ratio; and that in this satisfactory range, neither the ghost image nor the foggy background results. The image deterioration resulting when the volumetric ratio is low is considered as being caused by the negative property, while the deterioration when the volumetric ratio is too large is considered as being caused by the closed or covered sleeve surface resulting from the large amount of the magnetic particles, thus reducing too much the toner supply from the sleeve surface.

If the volumetric ratio is less than 1.5%, the image reproducibility of a line image is not satisfactory with a remarkable decrease of the image density. If it is more than 30%, the magnetic particles can physically damage the surface of the photosensitive drum 1, and the toner particles can be kept deposited on the photosensitive drum as a part of the developed image, which is a problem at the subsequent image transfer or image fixing station.

In the region where the volumetric ratio is near 1.5%, a locally non-uniform development can occur (under particular conditions) when a large area solid black image is developed. For this reason, the volumetric ratio is determined such that this does not occur. For this purpose, it is more preferable that the volumetric ratio is not less than 2.6%, and therefore, this defines a further preferable range.

If the volumetric ratio is near 30%, the toner supply from the sleeve surface can be delayed in such a region adjacent the positions where the chains of the magnetic particles are contacted, for example, when the developing speed is high. If this occurs, a non-uniform developed image can result in the form of scales in the case of solid black image reproduction. In order to assure the prevention of this, the volumetric ratio is preferably not more than 26%.

Where the volumetric ratio is in the range of 1.5–30% (4% in this embodiment), the chains 51 of the magnetic particles are formed on the sleeve surface and are distributed sparsely to a satisfactory extent, as shown in FIG. 3, so that the toner particles on the chain surfaces and those on the sleeve surfaces are sufficiently opened toward the photosensitive drum 1, and the toner particles 100 on the sleeve 22 are transferred by the alternating electric field. Thus, almost all of the toner particles are consumable for the purpose of development. Accordingly, the development efficiency (the ratio of the toner consumable for the development to the overall toner present in the developing position), and also a high image density can be provided. Preferably, the fine but violent vibration of the chains is produced, by which the toner powder 100 deposited on the magnetic particles and the sleeve surface are sufficiently loosened. In any case, the trace of brushing or occurrence of the ghost image as in the magnetic brush development can be prevented. Additionally, the vibration of the chains enhances the frictional contact between the magnetic particles 27 and the toner particles 37, with the result of the increased triboelectric charging to the toner particles 37, by which the occurrence of the foggy background can be prevented. Also, the high development efficiency is suitable to the reduction of the size of the developing apparatus.

The volumetric ratio of the magnetic particles in the developing position is determined;

$$(M/h)\times(1/\rho)\times[C/(T+C)]$$

where

M is the weight of the developer (the mixture) per unit area of the sleeve surface when the erected chains are not formed ($g/cm^2$);

h is the height of the space of the developing position (cm);

$\rho$ is the true density (g/cm3);

C/(T+C) is the percentage of the magnetic (carrier) particles in the developer on the sleeve.

The percentage of the toner particles to the magnetic particles at the developing position as defined above is preferably 4–40% by weight.

In this embodiment, the alternating electric field is strong enough (large rate of change or large Vpp), the chains are released from the sleeve 22 surface or from their base portions, and the released magnetic particles 27 also reciprocate between the sleeve 22 and the photosensitive drum 1. Since the energy of the reciprocal movement of the magnetic particles is large, the above described effect of the vibration are further enhanced.

The above described behavior has been confirmed by a high speed camera available from Hitachi Seisakusho, Japan operable at the speed of 8000 frames/sec.

Even in the case where the clearance is reduced between the photosensitive drum 1 surface and the sleeve 22 surface so as to increase the contact pressure between the photosensitive drum 1 and the magnetic particle chains and to decrease the vibration, the clearance is still large enough at the inlet and outlet sides of the developing position, and therefore, the vibration is sufficient with the above described advantages.

On the contrary, if the clearance is increased, it is preferable that the magnetic particle chains 51 are contacted to the drum 1 surface when the magnetic field is applied, even if they do not contact the drum surface without the electric field.

A developing apparatus was constructed according to this embodiment, as shown in FIG. 2. As for the sleeve 22, an aluminum sleeve having the diameter of 20 mm was used after the surface thereof was treated by irregular sand-blasting with ALUNDUM abrasive. Within the sleeve 22, the magnet 23 magnetized with four poles was used, the N and S poles being arranged alternately along the circumference as shown in FIG. 1.

The maximum surface magnetic flux density by the magnet 23 was approximately 900 Gauss.

The blade 24 used had the thickness of 1.2 mm made of non-magnetic stainless steel. The angle $\theta$ was set 15 degrees.

As for the magnetic particles, ferrite particles exhibiting the resistivity property described hereinbefore (maximum magnetization of 60 emu/g) had the particle size of 70–50 microns (250/300 mesh), whose surface was treated by silicon resin.

The electric resistivities were such as shown in FIG. 1 by reference characters n, o, p and q. Good image formation was confirmed.

In the system such as shown in FIG. 1 wherein the toner particles are taken into the magnetic powder on the developing sleeve using circulation of the magnetic powder, it is preferable that the resistivity of the magnetic particles is preferably not high. This is because the toner introduction into the magnetic powder is stabilized by reducing the charge of the magnetic particles per se. If the chargeability of the magnetic particles is high, the toner particles are strongly deposited on the magnetic particles, and therefore, when the toner particles are taken into the magnetic particle layer, it is difficult that the already deposited toner particles are replaced with the new toner particles. Therefore, some toner particles already deposited on the magnetic particles are retained thereon for a long term, with the result that those toner particles are overcharged. It is preferable that the resistivity property curve of the magnetic particles preferably crosses an area defined by lines connecting the points E, F, G and H in FIG. 1. Further preferably, it crosses lines EG and FH.

As for the non-magnetic toner, blue powder provided by a mixture of 100 parts of styrene/butadiene copolymer resin and 5 parts of copper phthalocyanine pigments, and added by 0.6 % of the colloidal silica, was used. The average particle size of the toner particles was 10 microns. Upon operation, approximately 10–30 microns thickness of the toner layer was obtained on the sleeve 22 surface, and above the toner layer, the magnetic particle layer of 200–300 microns thickness was formed. On the surfaces of the magnetic particles, there were toner particles.

At that time, the total weight of the magnetic particles and the toner particles on the sleeve 22 was approximately $2.43\times10^{-2}$ g/cm$^2$.

The weight ratio of the toner particles deposited on the magnetic particles and the toner particles deposited on the sleeve was approximately 2:1.

The magnetic particles were formed into erected chains at and adjacent the developing position by the magnetic pole **23*b* within the sleeve 22**. The maximum height of the chains was approximately 1.2 mm.

The amount of electric charge was measured by a blow-off method, and the triboelectric charge of the toner particles on the sleeve 22 and the magnetic particles was +12 mC/g. commercial copying machine, PC-10 sold by Canon Kabushiki Kaisha, Japan. The clearance between the surface of the photosensitive drum 3 made of organic photoconductor material and the surface of the sleeve 22 was set 350 microns. The volumetric ratio under those conditions was approximately 10% ($h=350$ microns, $M=2.43\times10^{-2}$ g/cm$^2$, $\rho=5.5$ g/cm$^3$, $C/(T+C)=20.4\%$) The bias voltage source 4 provided an alternating voltage having the frequency of 1600 Hz, wherein an alternating voltage having the peak-to-peak value of 1300 V was superimposed with a DC voltage of −300 V. When this was operated, good blue images were obtained.

The developing operation was performed to obtain a solid image, and then the surface of the sleeve 22 was carefully observed after the developing operation. It was confirmed that almost all of the toner particles on the sleeve and on the magnetic particles were consumed up, and therefore, the developing operation was effected with almost 100% development efficiency.

It was confirmed that the development properties were good enough without foggy background and without carrier deposition.

As regards the magnetic member 31, good introduction of the magnetic particles, good prevention of leakage and good circulation have been confirmed.

As described in the foregoing, the present embodiment is advantageous in the high image density, high development efficiency, no foggy background, no ghost image, no trace of brushing and no negative property.

Usable materials for the sleeve 22 are conductive material such as aluminum, brass and stainless steel and a cylinder of paper or synthetic resin. By processing the surface of those cylinders with conductive material, or by constituting the surface by a conductive material, it can serve as a developing electrode. As an alternative, a core roller is used which is wrapped by a conductive and elastic member, for example, a conductive sponge.

As regards the magnetic pole **23*b*** at the developing position, it is disposed at the center of the developing station in the direction of the movement of the surfaces of the photosensitive member and the sleeve. However, it may be deviated from the center, or the developing position may be disposed between magnetic poles.

To the toner powder, silica particles may be added to enhance the flowability, or abrasive particles or the like may be added to abrade the surface of the photosensitive drum 1 (latent image bearing member) in an image transfer type image forming apparatus. To the toner powder, a small amount of magnetic particles may be added. Magnetic particles may be used if the magnetic property thereof is very weak as compared with that of the magnetic particles and is triboelectrically chargeable.

In order to prevent the occurrence of the ghost image, the developer layer remaining on the sleeve 22 after the developing action may be once scraped off by scraper means (not shown), and then the scraped sleeve surface of brought into contact to the magnetic particle layer in the container, and then the developer is applied thereon. This is effective to prevent the ghost image.

A mechanism may be added to the developing apparatus, which detects the content of the magnetic particles and the toner particles, and in response to the detection, the toner is automatically supplied.

The developing apparatus according to this embodiment is usable with a disposable developing device which contains as a unit the container 36, the sleeve 22 and the blade 24, although it is applicable to usual developing device which is fixed in an image forming apparatus.

By using the magnetic carrier particles, fine particle toner having the particle size of not more than 10 microns can be used.

The present invention is applicable to a developing method using two component developer and using only DC voltage as the developing bias, with the advantage of prevention of the carrier deposition.

According to this invention, good images can be provided without carrier deposition and without void in a solid black image.

According to this embodiment, the toner content can be stably maintained in a simple structure developing device using two component developer containing magnetic particles and toner particles mixed and stirred together, which is carried on a developer carrying member such as a sleeve or belt. More particularly, since the developing conditions are not deteriorated, the functions of the magnetic particles are stabilized, so that the developing operation is also stabilized.

The present invention is also effective in a small size developing apparatus using a small diameter developing roller, in which case the amount of the magnetic particles on the sleeve decreases because of the decreased size of the developing roller, since the introduction of the toner particles into the magnetic powder layer is stabilized.

Figure 4:
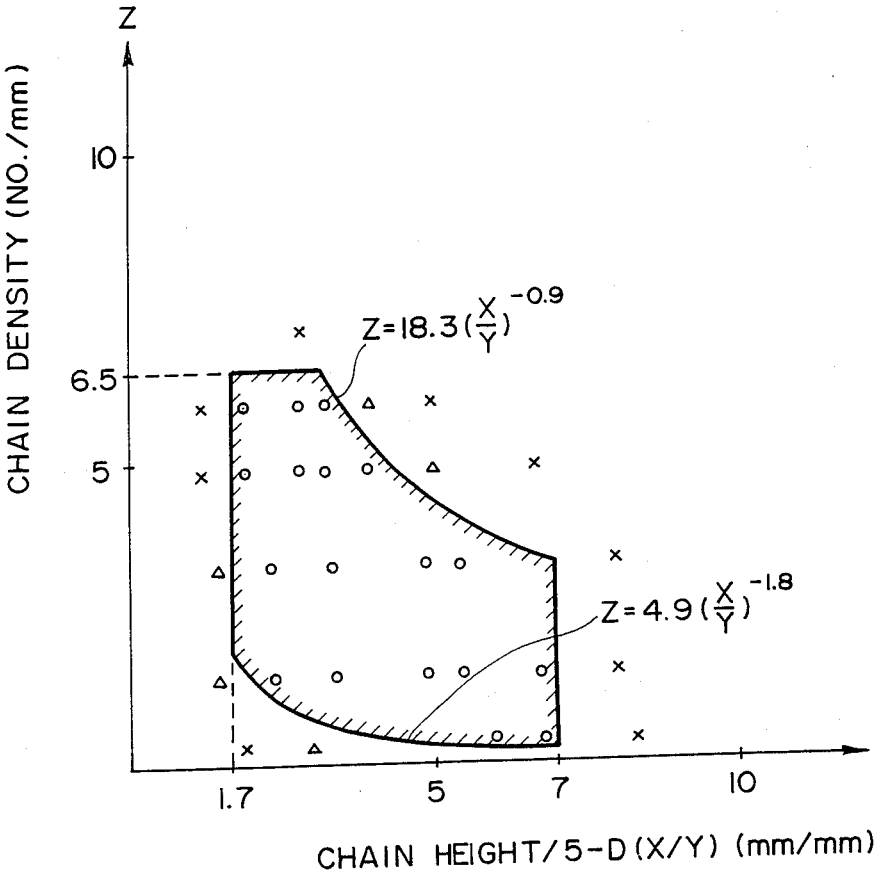
FIG. 4 is a graph of a density of magnetic particle chain VS a chain height with the quality of the image in the developing apparatus according to the present invention.
Figure 5:
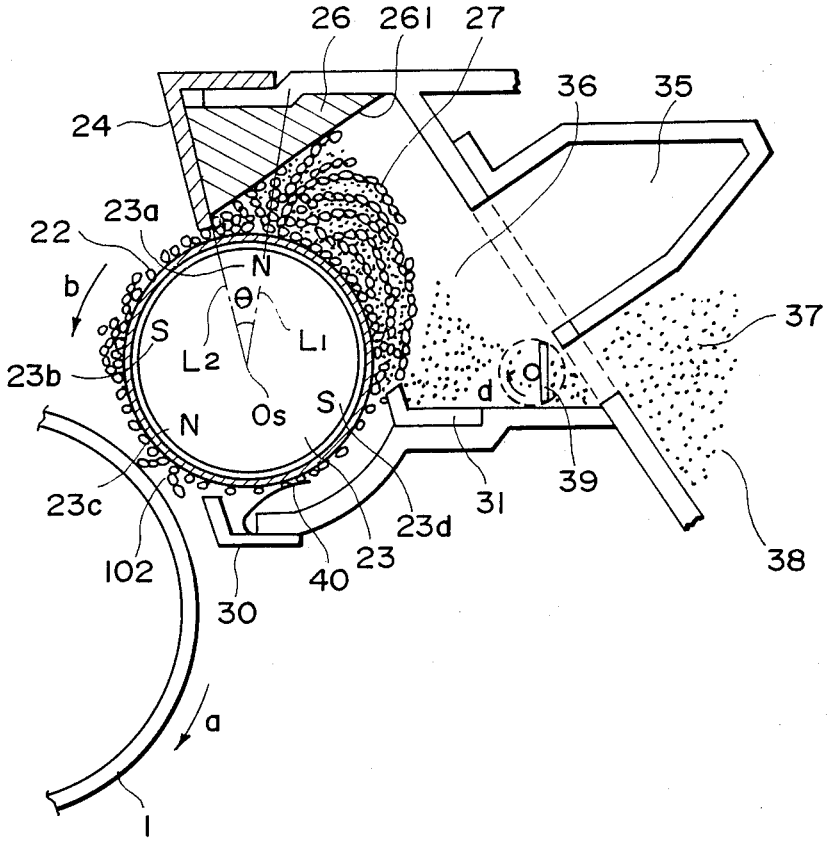
FIG. 5 is a sectional view of a developing apparatus according to another embodiment of the present invention.
Figure 6:
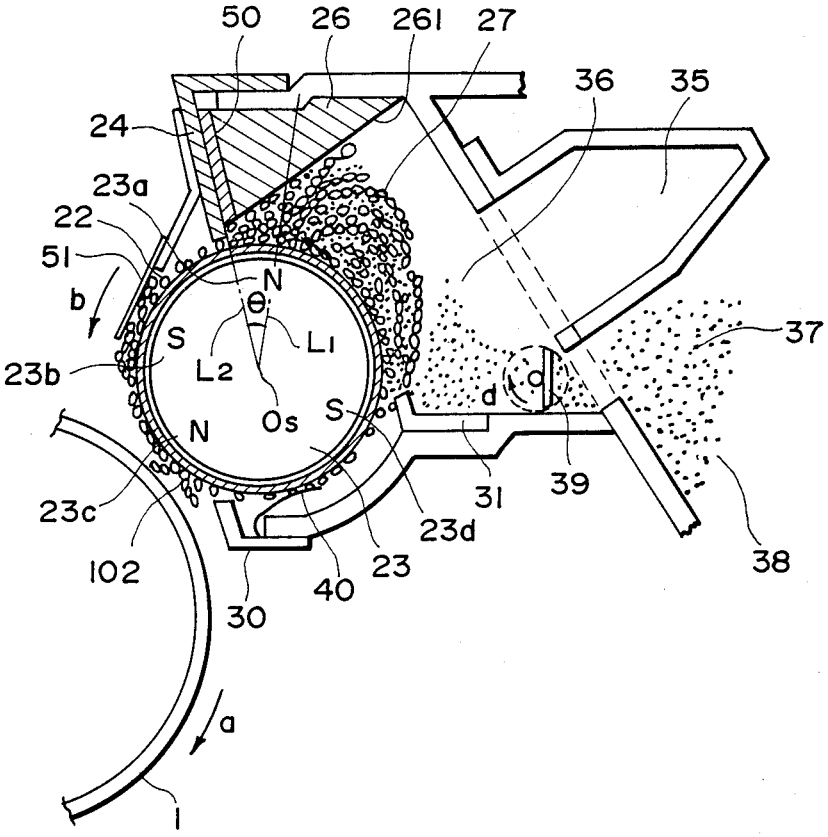
FIG. 6 is a sectional view of a developing apparatus according to a further embodiment of the present invention.

Referring to FIGS. 4–6, another embodiment of the present invention will be described.

FIG. 5 shows a developing apparatus of this embodiment which is substantially the same as the developing device of FIG. 2 except that the magnetic blade 50 is omitted. Therefore, in this embodiment, the regulating zone is formed by the non-magnetic blade 24 and the developer limiting member 26 (guiding surface 261). In this embodiment, a stabilized amount of magnetic particles and sufficiently charged toner particles can be supplied to the developing zone in the form of thin layer of the mixture thereof.

FIG. 6 shows an embodiment which contains all the structure of the FIG. 2 apparatus, and in addition, contains a leveling member 51 downstream of the regulating zone. The leveling member 51 is in contact with the surface of the developer layer regulated.

When the diameter of the developing sleeve is 10–30 mm, the disturbance of the developer layer on the sleeve is not significant if the angular interval between the regulating pole and the developing pole is not less than 120 degrees, preferably 100 degrees, as seen from the center of the sleeve. If, however, it is larger than 120 degrees, the disturbance of the developer layer is significant, and therefore, it is preferable that a conveying pole is provided between the magnetic poles 23*a* and 23*c*.

The description will be made with respect to influence on the image by the state of magnetic particle chain erection and the smallest distance between the developing sleeve 22 and the latent image bearing member 1 in the developing zone or position (S/D gap). Various experiments have been conducted using a developing device having the basic structure shown in FIG. 6 with different five factors, i.e. a gap between the surface of the sleeve 22 and the free edge of the blade 24 (S-B gap), an angle between the blade 24 and the regulating pole 23*a* (degrees), strength of the developing pole 23*c*, strength of the regulating pole 23*a* and the presence or absence of the leveling member 51 for leveling the developer layer formed on the developing sleeve 22. With those different structures, the height of the chain and the density of the chain are changed. Table 2 shows the different factors and the chain height and the chain density.

TABLE 2

| DEV. DEVICE NO. | S-D GAP (micron) | ANGLE $\theta$ (deg.) | STRENGTH OF DEV. POLE (G) | STRENGTH OF REG. POLE (G) | LEVELING MEMBER | CHAIN HEIGHT IN DEV. ZONE (mm) | CHAIN DENSITY IN DEV. ZONE (No./mm$^2$) |
|---|---|---|---|---|---|---|---|
| A | 350 | 15 | 750 | 1050 | YES | 1.0 | 7.1 |
| B | 350 | 15 | 750 | 950 | NO | 1.0 | 5.9 |
| C | 300 | 15 | 800 | 950 | NO | 1.0 | 4.8 |
| D | 270 | 20 | 850 | 830 | NO | 1.2 | 3.2 |
| E | 350 | 15 | 800 | 850 | NO | 1.2 | 1.4 |
| F | 350 | 10 | 1000 | 800 | NO | 1.5 | 0.3 |

The magnetic particles are made of ferrite (maximum magnetization 600 emu/g) having an average particle size of 52 microns and coated with silicone resin.

As to the relation between the state of the chain erection in the developing zone and the S-D gap, if the amount of the magnetic particles exceeds a certain level, the developer is stagnated in the gap between the developing sleeve 2 and the photosensitive drum 1, and the foggy background is produced; if, on the contrary, the amount of the magnetic particles is lower than a certain level, the resultant image density becomes too low. Then, using the developing devices A–F shown in Table 2, the S–D gap was changed from 0.15 mm to 0.80 mm, and the image developing operations were performed to evaluate the carrier particle stagnation in the gap between the sleeve and the photosensitive drum, the carrier deposition in the solid black area ($V_d$), the carrier deposition in the white area ($V_L$), Dmax and the roughening of the solid black image. The image forming operation was performed for a latent image having a light area potential of −600 V ($V_d$) and the light area potential of −150 V ($V_L$), and with an alternating electric field formed between the photosensitive drum 1 and the developing sleeve 22. The developing bias voltage had a peak-to-peak voltage of 1.0 KV–2.5 KV and the frequency of 1 KHz–3 KHz. The results are shown in Tables 3-1 and 3-2.

TABLE 3-1

| NO. | DEV. DEVICE NO. | HEIGHT (X) (mm) | S-D (Y) (mm) | X/Y | DENSITY (No./mm$^2$) |
|---|---|---|---|---|---|
| 1 | A | 1.0 | 0.35 | 2.86 | 7.1 |
| 2 | B | " | 0.80 | 1.25 | 5.9 |
| 3 | | " | 0.50 | 2.00 | " |
| 4 | | " | 0.35 | 2.86 | " |
| 5 | | " | 0.30 | 3.33 | " |
| 6 | | " | 0.25 | 4.00 | " |
| 7 | | " | 0.20 | 5.00 | " |
| 8 | C | " | 0.80 | 1.25 | 4.8 |
| 9 | | " | 0.50 | 2.00 | " |
| 10 | | " | 0.35 | 2.86 | " |
| 11 | | " | 0.30 | 3.33 | " |
| 12 | | " | 0.25 | 4.00 | " |
| 13 | | " | 0.20 | 5.00 | " |
| 14 | | " | 0.15 | 6.67 | " |
| 15 | D | 1.2 | 0.80 | 1.50 | 3.2 |
| 16 | | " | 0.50 | 2.40 | " |
| 17 | | " | 0.35 | 3.43 | " |
| 18 | | " | 0.25 | 4.80 | " |
| 19 | | " | 0.22 | 5.45 | " |
| 20 | | " | 0.18 | 6.67 | " |
| 21 | | " | 0.15 | 8.00 | " |
| 22 | E | " | 0.80 | 1.50 | 1.4 |
| 23 | | " | 0.50 | 2.40 | " |

TABLE 3-1-continued

| NO. | DEV. DEVICE NO. | HEIGHT (X) (mm) | S-D (Y) (mm) | X/Y | DENSITY (No./mm²) |
|---|---|---|---|---|---|
| 24 | | " | 0.35 | 3.43 | " |
| 25 | | " | 0.25 | 4.80 | " |
| 26 | | " | 0.22 | 5.45 | " |
| 27 | | " | 0.18 | 6.67 | " |
| 28 | | " | 0.15 | 8.00 | " |
| 29 | F | 1.5 | 0.80 | 1.88 | 0.3 |
| 30 | | " | 0.50 | 3.00 | " |
| 31 | | " | 0.35 | 4.29 | " |
| 32 | | " | 0.25 | 6.00 | " |
| 33 | | " | 0.22 | 6.82 | " |
| 34 | | " | 0.18 | 8.33 | " |

TABLE 3-2

| NO. | DEV. DEVICE NO. | STAGNA-TION | CARRIER DEPOSITION | FOG | Dmax | ROUGHNING (SOLID BLACK) |
|---|---|---|---|---|---|---|
| 1 | A | G | N | F | G | G |
| 2 | B | G | G | G | N | G |
| 3 | | G | G | G | G | G |
| 4 | | G | G | G | G | G |
| 5 | | G | G | G | G | G |
| 6 | | G | F | F | G | G |
| 7 | | G | N | F | G | G |
| 8 | C | G | G | G | N | G |
| 9 | | G | G | G | G | G |
| 10 | | G | G | G | G | G |
| 11 | | G | G | G | G | G |
| 12 | | G | G | G | G | G |
| 13 | | G | F | G | G | G |
| 14 | | G | N | N | G | G |
| 15 | D | G | G | G | F | G |
| 16 | | G | G | G | G | G |
| 17 | | G | G | G | G | G |
| 18 | | G | G | G | G | G |
| 19 | | G | G | G | G | G |
| 20 | | G | G | G | G | G |
| 21 | | N | — | — | — | — |
| 22 | E | G | G | G | F | G |
| 23 | | G | G | G | G | G |
| 24 | | G | G | G | G | G |
| 25 | | G | G | G | G | G |
| 26 | | G | G | G | G | G |
| 27 | | G | G | G | G | G |
| 28 | | N | — | — | — | — |
| 29 | F | G | G | G | G | N |
| 30 | | G | G | G | G | F |
| 31 | | G | G | G | G | G |
| 32 | | G | G | G | G | G |
| 33 | | G | G | G | G | G |
| 34 | | N | — | — | — | — |

G: Good,
F: Fairly Good,
N: Non-practical

A parameter X/Y, where X is a height of the chain in the developing zone and Y is the S-D clearance, is introduced so that the comparison among the developing devices A–F can be made on the same level.

FIG. 4 is a graph produced on the basis of Tables 3–1 and 3–2, wherein the abscissa represents the parameter X/Y, and the ordinate represents a density Z of the chain in the developing zone on the sleeve surface. In this graph, o means that all the above described five factors are "good"; Δ means that at least one of the five factors are "fairly good"; and x means that at least one of the five factors is "non-practical".

As will be understood from this Figure, the region having no problem with respect to all of the five factors is limited to the area enclosed by four curves. The conditions represented by a point outside this region result in the carrier stagnation, the insufficient image density or the like.

The meaning of the region will be further described. One of the four curves is defined by $$Z=18.3(X/Y)^{-0.9}$$

If the density Z is larger than this, the carrier deposition is increased, and the background becomes more foggy. The reason for this is considered to be that the amount of the developer existing in the developing zone is so large that the magnetic field is weakened in the substantial developing zone, particularly the neighborhood of the surface of the image bearing member so as to make the carrier deposition easier; and that because the amount of the developer is large, the regulation adjacent the nonmagnetic blade is weak, resulting in the foggy background. Therefore, $$Z \leqq 18.3(X/Y)^{-0.9}$$

is desirable.

The second curve is defined by $$Z=4.9(X/Y)^{-1.8}$$

If Z is smaller than this, the density Dmax is not sufficient, and/or a solid black image is roughened. The roughening is the phenomenon that in a large area solid black image, localized high density and low density portions appear, which is liable to occur under special ambient conditions. This is considered to be because the amount of the magnetic particles or chains in the developing zone is so small that sufficient toner particles are not supplied into the developing zone, resulting in insufficient image density and resulting in that the image density is partly increased in the portions where the chains exist as compared with the portions where the chains do not exist, so that the image is roughened. Therefore, the following is desirable.

$$Z \geqq 4.9(X/Y) - 1.8.$$

The third and fourth lines are defined by $$X/Y = 7; \text{ and}$$
$$X/Y = 1.7$$

If $X/Y > 7$, the developer stagnates in the gap between the sleeve and the drum with the result that the development is disabled. If, on the contrary, $X/Y < 1.7$, the image density becomes insufficient. The reason for this is considered to be that the gap between the developing sleeve 22 and the image bearing member 1 is too large, and therefore, the tone particles on the developing sleeve 22 are not sufficiently used for the development. Therefore, $$1.7 \leqq X/Y \leqq 7.0$$

is desirable.

Finally, if $Z > 6.5$, almost all portions on the developing sleeve are covered by the chains, so that it becomes not possible to supply the toner particles from the surface of the sleeve. If X/Y is made larger in an attempt to increase the image density, the carrier deposition is increased, whereas if an attempt is made to prevent the carrier deposition, the image density becomes insufficient. Therefore, $$Z \leqq 6.5$$

is desirable.

Accordingly, if the conditions correspond to a point in the hatched area of FIG. 4, the chains 51 of the magnetic particles are formed on the sleeve surface and are distributed sparsely to a satisfactory extent, so that the toner particles on the chain surfaces and those on the sleeve surfaces are sufficiently opened toward the photosensitive drum 1, and the toner particles on the sleeve 22 are transferred by the alternating electric field. Thus, almost all of the toner particles are consumable for the purpose of development.

Accordingly, the development efficiency (the ratio of the toner consumable for the development to the overall toner present in the developing position), and also a high image density can be provided Preferably, the fine but violent vibration of the chains is produced, by which the toner powder deposited on the magnetic particles and the sleeve surface are sufficiently loosened.

In any case, the trace of brushing or occurrence of the ghost image as in the conventional magnetic brush development can be prevented. Additionally, the vibration of the chains enhances the frictional contact between the magnetic particles 27 and the toner particles 28, with the result of the increased triboelectric charging to the toner particles 28, by which the occurrence of the foggy background can be prevented. Also, the high development efficiency is suitable to the reduction of the size of the developing apparatus.

Referring to FIG. 2, the south pole 23b may be used as the developing pole, although the magnetic pole 23c may be used for the developing magnetic pole.

The percentage of the toner particles to the magnetic particles at the developing position is preferably 4–40% by weight.

In this embodiment, the alternating electric field is strong enough (large rate of change or large Vpp), the chains 51 are released from the sleeve 22 surface or from their base portions, and the released magnetic particles 27 also reciprocate between the sleeve 22 and the photosensitive drum 1. Since the energy of the reciprocal movement of the magnetic particles is large, the above described effect of the vibration are further enhanced.

The above described behavior has been confirmed by the high speed camera available from Hitachi Seisakusho, Japan operable at the speed of 8000 frames/sec.

Even in the case where the clearance is reduced between the photosensitive drum 1 surface and the sleeve 22 surface so as to increase the contact pressure between the photosensitive drum 1 and the magnetic particle chains 51 and to decrease the vibration, the clearance is still large enough at the inlet and the outlet sides of the developing position, and therefore, the vibration is sufficient with the above described advantages.

A developing apparatus was constructed according to this embodiment, as shown in FIGS. 5 and 6. As for the sleeve 22, aluminum sleeves having the diameters of 16 mm and 20 mm were used after the surface thereof was treated by irregular sand-blasting with ALUNDUM abrasive. Within the sleeve 22, the magnet 23 magnetized with four poles was used, the N and S poles being arranged alternately along the circumference.

The blade 24 used had the thickness of 1.2 mm made of non-magnetic stainless steel.

As for the magnetic particles, ferrite particles (maximum magnetization of 60 emu/g) had the particle size of 70–50 microns (250/300 mesh), whose surface was treated by silicon resin.

As for the non-magnetic toner, blue powder provided by a mixture of 100 parts of styrene/butadiene copolymer resin and 5 parts of copper phthalocyanine pigments, and added by 0.6% of the colloidal silica, was used. Upon operation, approximately 10–30 microns thickness of the toner layer was obtained on the sleeve 22 surface.

The amount of electric charge was measured by a blow-off method, and the triboelectric charge of the toner particles on the sleeve 22 and the magnetic particles was +6–+18 micro-C/g.

The developing operation was performed to obtain a solid image, and then the surface of the sleeve 22 was carefully observed after the developing operation. It was confirmed that almost all of the toner particles on the sleeve and on the magnetic particles were consumed up, and therefore, the developing operation was effected with almost 100 % development efficiency.

As described in the foregoing, the present embodiment is advantageous in the high image density, high development efficiency, no foggy background, no ghost image, no trace of brushing and no negative property.

Usable materials for the sleeve 22 are conductive material such as aluminum, brass and stainless steel and a cylinder of paper or synthetic resin. By processing the surface of those cylinders with conductive material, or by constituting the surface by a conductive material, it can serve as a developing electrode. As an alternative, a core roller is used which is wrapped by a conductive and elastic member, for example, a conductive sponge.

As regards the magnetic pole 23c at the developing position, it is disposed at the center of the developing station in the direction of the movement of the surfaces of the photosensitive member and the sleeve. However, it may be deviated from the center, or the developing position may be disposed between magnetic poles.

To the toner powder, silica particles may be added to enhance the flowability, or abrasive particles or the like may be added to abrade the surface of the photosensitive drum 1 (latent image bearing member) in an image transfer type image forming apparatus. To the toner powder, a small amount of magnetic particles may be added. Magnetic particles may be used if the magnetic property thereof is very weak as compared with that of the magnetic particles and is triboelectrically chargeable.

In order to prevent the occurrence of the ghost image, the developer layer remaining on the sleeve 22 after the developing action may be once scraped off by scraper means (not shown), and then the scraped sleeve surface is brought into contact with the magnetic particle layer in the container, and then the developer is applied thereon. This is effective to prevent the ghost image.

A mechanism may be added to the developing apparatus, which detects the content of the magnetic particles and the toner particles, and in response to the detection, the toner is automatically supplied.

The developing apparatus according to this embodiment is usable with a disposable developing device which contains as a unit the container 36, the sleeve 22 and the blade 24, although it is applicable to usual developing device which is fixed in an image forming apparatus.

As described in the foregoing, the development operation can be performed with high image density and high development efficiency and without foggy background, ghost image, trace of brushing and negative property, if the following five requirements are satisfied.

$$1.7 \leqq X/Y \leqq 7.0$$

$$4.9(X/Y)^{-8} \leqq Z \leqq 18.33(X/Y)^{-0.9}$$

$$Z \leqq 6.5$$

The developing apparatus wherein an electric resistivity curve of the magnetic particles on a coordinate graph wherein abscissa represents an electric field E (V/cm) applied to the magnetic particles, and ordinate represents an electric resistivity R (ohm-cm) of the magnetic particles crosses a zone defined by lines AB, BD, DC and CA, where A is a point with coordinates ($0.2\times10^3$, $10^{11}$);

B is a point with coordinates ($2\times10^3$, $3\times10^9$);

C is a point with coordinates ($0.2\times10^3$, $10^8$); and

D is a point with coordinates ($2\times10^3$, $2\times10^7$), wherein the resistivity R is measured by a sandwich type cell having electrodes with a clearance of 0.4 cm and having electrode area of 4 $cm^2$, in which 1 kg wt. is applied to one of the electrodes, and a voltage is applied across the electrodes; and wherein $$1.7 \leqq (X/Y) \leqq 7.0;$$

$$4.9(X/Y)^{-1.8} \leqq Z \leqq 18.3(X/Y)^{-0.9}; \text{ and}$$

$$Z \leqq 6.5$$

are satisfied, where Z is a number of chains of the magnetic particles per 1 $mm^2$ on the surface of the developer carrying member in the developing zone, X (mm) is height of the chains in the developing zone, and Y (mm) is a smallest distance between the latent image bearing member and said developer carrying member, is particularly conveniently applicable to a developing apparatus wherein an alternating electric: field is formed in the developing zone for transferring the toner particles from the surface of the developer carrying member to a latent image bearing member. In this apparatus, even if the number of chains becomes unstable due to a variation in the toner content or variations in the structure of the apparatus, and even if the developing conditions become temporarily outside the hatched area, the above described resistivity property is effective to prevent the loss of the carrier particles, thus providing a compensating effect to maintain the image quality. If, on the contrary, the resistivity becomes out of the above described area due to deterioration of the carrier particles or due to a specific ambient condition, the loss of the carrier particles can be prevented by the function of the chains described above, thus providing the compensating effect. The application of the alternating electric field is effective to overcome slightly bad conditions if one of the requirements is satisfied to make good image formation possible.

If the volumetric ratio is satisfied in addition to the above, the apparatus is able to accommodate further problems as will be understood from the foregoing explanation. In this case, a high speed development is possible.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus, comprising:

a developer container for containing a developer containing toner particles and resin coated magnetic particles;

a developer carrying member opposed to a latent image bearing member to form a developing zone;

means for forming a layer of the developer on a surface of said developer carrying member;

means for forming a magnetic field in the developing zone for conveying the magnetic particles into the developing zone;

means for forming an alternating electric field between the latent image bearing member and said developer carrying member in the developing zone;

wherein said magnetic particles are high resistance particles exhibiting an electric field dependence property, wherein an electric resistivity curve of the magnetic particles on a coordinate graph wherein abscissa represents an electric field E (V/cm) applied to the magnetic particles, and ordinate represents an electric resistivity R (ohm-cm) of the magnetic particles crosses a zone defined by lines AB, BD, DC and CA, where A is a point with coordinates ($0.2\times10^3$, $10^{11}$); B is a point with coordinates ($2\times10^3$, $3\times10^9$); C is a point with coordinates ($0.2\times10^3$, $10^8$); and D is a point with coordinates ($2\times10^3$, $2\times10^7$), wherein the resistivity R is measured by a sandwich type cell having electrodes with a clearance of 0.4 cm and having electrode area of 4 $cm^2$, in which 1 kg wt. is applied to one of the electrodes, and a voltage is applied across the electrodes.

2. An apparatus according to claim 1, wherein the resistivity curve is crossed with the line AC and the line BD, and wherein a volumetric ratio of the total volume of the magnetic particles existing at the developing zone to a volume of space defined by the surface of the electrostatic latent image bearing member and the developer carrying member at the developing zone, is 1.5–30%.

3. An apparatus according to claim 1, wherein the resistivity curve is crossed with the line AC and the line BD, and it is all contained in the area within a range of electric field not less than $0.2\times10^3$ (V/cm) and not more than $2\times10^3$ (V/cm).

4. An apparatus according to claim 1, wherein the resistivity curve is within a region defined by connecting points E ($0.2\times10^3$, $2\times10^{10}$), F($2\times10^3$). $10^9$), H ($2\times10^3$, $5\times10^7$), G ($0.2\times10^3$, $2\times10^8$).

5. An apparatus according to claim 4, wherein a volumetric ratio of the total volume of the magnetic particles existing at the developing zone to a volume of space defined by the surface of the electrostatic latent image bearing member and the developer carrying member at the developing position, is 1.5–30%.

6. An apparatus according to claim 1, wherein $$1.7\leqq(X/Y)\leqq7.0;$$

$$4.9(X/Y)^{-1.8}\leqq Z\leqq18.3(X/Y)^{-0.9};\text{ and}$$

$$Z\leqq6.5$$

are satisfied, where Z is a number of chains of the magnetic particles per 1 $mm^2$ on the surface of the developer carrying member in the developing zone, X (mm) is height of the chains in the developing zone, and Y (mm) is a smallest distance between the latent image bearing member and said developer carrying member.

7. An apparatus according to claim 6, wherein the resistivity curve is within a region defined by connecting points E ($0.2\times10^3$, $2\times10^{10}$), F ($2\times10^3$, $10^9$), H ($2\times10^3$, $5\times10^7$), G ($0.2\times10^3$, $2\times10^8$).

8. An apparatus according to claim 6, wherein a volumetric ratio of the total volume of the magnetic particles existing at the developing zone to a volume of space defined by the surface of the electrostatic latent image bearing member and the developer carrying member at the developing position, is 1.5–30%.

9. An apparatus according to claim 8, wherein the resistivity curve is within a region defined by connecting points E ($0.2\times10^3$, $2\times10^{10}$), F ($2\times10^3$, $10^9$), H ($2\times10^3$, $5\times10^7$), G ($0.2\times10^3$, $2\times10^8$).

10. A developing apparatus for developing an electrostatic latent image on an electrostatic latent image bearing member, comprising:

a container for containing a developer which contains toner particles and magnetic particles;

a developer carrying member, opposed to the electrostatic latent image bearing member, for forming a developing zone for supplying the toner particles to the latent image bearing member and for carrying the developer from said container to the developing position;

first magnetic field generating means disposed across said developer carrying member from the latent image bearing member for generating a magnetic field to contact the magnetic particles to the latent image bearing member at the developing zone;

developer regulating means, disposed upstream of the developing zone with respect to movement of a surface of said developer carrying member and spaced apart from the surface of said developer carrying member, for regulating the developer carried to the developing zone;

second magnetic field generating means disposed across said developer carrying member from said regulating means and disposed upstream of said developer regulating means with respect to the movement; and alternating electric field generating means for forming an alternating electric field at the developing zone to transfer the toner particles carried on said developer carrying member to the latent image bearing member;

wherein $$1.7\leqq(X/Y)\leqq7.0;$$

$$4.9(X/Y)^{-1.8}\leqq Z\leqq18.3(X/Y)^{-0.9};\text{ and}$$

$$Z\leqq6.5$$

are satisfied, where Z is a number of chains of the magnetic particles per 1 $mm^2$ on the surface of the developer carrying member in the developing zone, X (mm) is height of the chains in the developing zone, and Y (mm) is a smallest distance between the latent image bearing member and said developer carrying member.

11. An apparatus according to claim 10, wherein the magnetic particles are ferrite particles having an average particle size of 50–60 microns.

12. An apparatus according to claim 10, wherein a volumetric ratio of the total volume of the magnetic particles existing at the developing zone to a volume of space defined by the surface of the electrostatic latent image bearing member and the developer carrying member at the developing position, is 1.5–30%.

13. A developing apparatus, comprising:

a developer container for containing a developer containing toner particles and magnetic particles;

a developer carrying member opposed to a latent image bearing member to form a developing zone;

means for forming a layer of the developer on a surface of said developer carrying member;

means for forming a magnetic field in the developing zone for conveying the magnetic particles into the developing zone;

means for forming an alternating electric field between the latent image bearing member and said developer carrying member in the developing zone;

wherein said magnetic particles are high resistance particles exhibiting an electric field dependence property; and wherein an electric resistivity curve of the magnetic particles on a coordinate graph wherein abscissa represents an electric field E (V/cm) applied to the magnetic particles, and ordinate represents an electric resistivity R (ohm-cm) of the magnetic particles crosses a zone defined by lines AB, BD, DC and CA, where A is a point with coordinates ($0.2\times10^3$, $10^{11}$);
B is a point with coordinates ($2\times10^3$, $3\times10^9$);
C is a point with coordinates ($0.2\times10^3$, $10^8$); and
D is a point with coordinates ($2\times10^3$, $2\times10^7$), wherein the resistivity R is measured by a sandwich type cell having electrodes with a clearance of 0.4 cm and having electrode area of 4 $cm^2$, in which 1 kg wt. is applied to one of the electrodes, and a voltage is applied across the electrodes;

wherein $$1.7 \leqq (X/Y) \leqq 7.0;$$

$$4.9(X/Y)^{-1.8} \leqq Z \leqq 18.3(X/Y)^{-0.9}; \text{ and}$$

$$Z \leqq 6.5$$

are satisfied, where Z is a number of chains of the magnetic particles per 1 $mm^2$ on the surface of the developer carrying member in the developing zone, X (mm) is height of the chains in the developing zone, and Y (mm) is a smallest distance between the latent image bearing member and said developer carrying member.

14. An apparatus according to claim 13, wherein a volumetric ratio of the total volume of the magnetic particles existing at the developing zone to a volume of space defined by the surface of the electrostatic latent image bearing member and the developer carrying member at the developing position, is 1.5–30%.

* * * * *

UNITED STATES PATENT AND TRADEMARK OFFICE

CERTIFICATE OF CORRECTION

PATENT NO. : 4,873,551

DATED : October 10, 1989

INVENTOR(S) : HATSUO TAJIMA, ET AL.

It is certified that error appears in the above-identified patent and that said Letters Patent is hereby corrected as shown below:

IN [57] ABSTRACT

Line 7, "developer" should read --a developer--.
Line 17, "(0.2 X 103, $10^8$);" should read --(0.2 X $10^3$, $10^8$);--.

COLUMN 1

Line 16, "assigned" should read --are assigned--.
Line 65, "1014" should read --$10^{14}$--.

COLUMN 4

Line 13, "not sufficiently" should read --not being sufficiently--.

COLUMN 8

Line 28, "or" should read --on--.
Line 34, "devloping" should read --developing--.

COLUMN 9

Line 7, "the" (second occurrence) should read --be--.
Line 42, "4.0x108 ohm.cm" should read --4.0 X $10^8$ ohm.cm--.

COLUMN 10

Line 28, "g," should read --q,--.
Line 56, "image" should read --images--.

--

UNITED STATES PATENT AND TRADEMARK OFFICE

CERTIFICATE OF CORRECTION

PATENT NO. : 4,873,551

DATED : October 10, 1989

INVENTOR(S) : HATSUO TAJIMA, ET AL.

It is certified that error appears in the above-identified patent and that said Letters Patent is hereby corrected as shown below:

COLUMN 11

Line 18, "is" should read --are--.
Line 33, "is" should read --are--.
Line 44, "E=2x103 (V/cm)" should read --E=2 X $10^3$ (V/cm)--.

COLUMN 12

Line 42, "developing sleeve 2." should read --developing sleeve 22.--.

COLUMN 14

Line 44, "are" should read --is--.

COLUMN 15

Line 58, "+12 mC/g. commercial" should read --+12 mC/g. ¶ The developing apparatus was assembled into a commercial--.

COLUMN 16

Line 48, "of brought" should read --is brought--.

COLUMN 19

TABLE 3-2, "ROUGHNING" should read --ROUGHENING--.

--

UNITED STATES PATENT AND TRADEMARK OFFICE

CERTIFICATE OF CORRECTION

PATENT NO. : 4,873,551

DATED : October 10, 1989

INVENTOR(S) : HATSUO TAJIMA, ET AL.

It is certified that error appears in the above-identified patent and that said Letters Patent is hereby corrected as shown below:

COLUMN 20

Line 59, "Z=4.9(X/Y)⁻1.8" should read --$Z=4.9(X/Y)^{-1.8}$--.

COLUMN 21

Line 7, "$Z \geqq 4.9(X/Y)-1.8$." should read --$Z \geqq 4.9(X/Y)^{-1.8}$.--.
Line 20, "tone" should read --toner--.
Line 50, "provided" should read --provided.--.

COLUMN 22

Line 11, "are" should read --is--.

COLUMN 23

Line 39, "five" should be deleted.
Line 44, "$4.9(X/Y)^{-8} \leqq Z \leqq 18.33(X/Y)^{-0.9}$" should read --$4.9(X/Y)^{-1.8} \leqq Z \leqq 18.3(X/Y)^{-0.9}$--.

COLUMN 24

Line 10, "electric: field" should read --electric field--.

--

UNITED STATES PATENT AND TRADEMARK OFFICE

CERTIFICATE OF CORRECTION

PATENT NO. : 4,873,551

DATED : October 10, 1989

INVENTOR(S) : HATSUO TAJIMA, ET AL.

It is certified that error appears in the above-identified patent and that said Letters Patent is hereby corrected as shown below:

COLUMN 25

Line 22, "F(2 X $10^3$). $10^9$)," should read --F(2 X $10^3$, $10^9$),--.

Signed and Sealed this

Seventh Day of May, 1991

*Attest:*

HARRY F. MANBECK, JR.

*Attesting Officer*

*Commissioner of Patents and Trademarks*